US008139095B2

(12) United States Patent
Nishitani et al.

(10) Patent No.: US 8,139,095 B2
(45) Date of Patent: Mar. 20, 2012

(54) RECORDING APPARATUS AND CONVEYANCE METHOD

(75) Inventors: Hitoshi Nishitani, Tokyo (JP); Yukiteru Yano, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 981 days.

(21) Appl. No.: 11/843,571

(22) Filed: Aug. 22, 2007

(65) Prior Publication Data

US 2008/0049091 A1 Feb. 28, 2008

(30) Foreign Application Priority Data

Aug. 28, 2006 (JP) ..... 2006-230157

(51) Int. Cl.
*B41J 17/28* (2006.01)

(52) U.S. Cl. ..... 347/217; 242/410

(58) Field of Classification Search ..... 347/217; 400/234; 242/410

See application file for complete search history.

(56) References Cited

U.S. PATENT DOCUMENTS

| | | | | | |
|---|---|---|---|---|---|
| 3,587,811 | A | * | 6/1971 | Smith et al. | 400/569 |
| 3,727,856 | A | * | 4/1973 | Kitch | 242/413.2 |
| 4,205,923 | A | * | 6/1980 | Sasaki et al. | 400/220.1 |
| 4,499,476 | A | * | 2/1985 | Inui et al. | 347/217 |
| 4,609,299 | A | * | 9/1986 | Hattori et al. | 400/229 |
| 4,641,150 | A | * | 2/1987 | Matsuura et al. | 347/197 |
| 4,650,351 | A | * | 3/1987 | Engle et al. | 400/234 |
| 4,687,358 | A | | 8/1987 | Saitou | |
| 4,788,558 | A | * | 11/1988 | Caldwell et al. | 347/215 |
| 5,001,498 | A | * | 3/1991 | Shimizu et al. | 347/215 |
| 5,595,447 | A | * | 1/1997 | Takayama et al. | 400/231 |
| 5,661,515 | A | * | 8/1997 | Hevenor et al. | 347/215 |
| 5,995,128 | A | * | 11/1999 | Adams et al. | 347/217 |
| 6,008,830 | A | | 12/1999 | Yamada | |
| 6,511,238 | B1 | * | 1/2003 | Glize | 400/234 |
| 6,626,098 | B1 | * | 9/2003 | Kanamori | 101/128.4 |
| 6,639,619 | B2 | * | 10/2003 | Ueda et al. | 347/217 |
| 6,753,894 | B2 | * | 6/2004 | Yoshida | 347/217 |

FOREIGN PATENT DOCUMENTS

| | | | | |
|---|---|---|---|---|
| CN | 1200986 | | | 12/1998 |
| JP | 59076287 | A | * | 5/1984 |
| JP | 60-240482 | A | | 11/1985 |
| JP | 04010971 | A | * | 1/1992 |
| JP | 05-169781 | A | | 7/1993 |
| JP | 05-193221 | | | 8/1993 |
| JP | 05-278285 | A | | 10/1993 |
| JP | 07-125396 | | | 5/1995 |
| JP | 07-148952 | | | 6/1995 |
| JP | 07-314833 | | | 12/1995 |
| JP | 08-1749979 | | | 7/1996 |
| JP | 09-174973 | | | 7/1997 |
| JP | 09-207417 | | | 8/1997 |
| JP | 10-119400 | | | 5/1998 |
| JP | 11-245458 | A | | 9/1999 |
| JP | 2004-314481 | A | | 11/2004 |

* cited by examiner

*Primary Examiner* — Charlie Peng
*Assistant Examiner* — Peter Radkowski
(74) *Attorney, Agent, or Firm* — Canon USA Inc IP Division

(57) ABSTRACT

In a recording apparatus, an ink ribbon is always placed under a tension by a stop torque of a torque limiter while a take-up bobbin is driven through the torque limiter when recording paper is conveyed near a stationary ink ribbon.

15 Claims, 14 Drawing Sheets

"PRIOR ART"

"PRIOR ART"

"PRIOR ART"

"PRIOR ART"

"PRIOR ART"

"PRIOR ART"

RECORDING APPARATUS AND CONVEYANCE METHOD

BACKGROUND OF THE INVENTION

1. Field of the Invention

The present invention relates to a recording apparatus which performs printing on a recording material in accordance with image information.

2. Description of the Related Art

FIGS. 12A and 12B illustrate a general configuration for performing a conventional thermal transfer recording. As illustrated in FIG. 12A, an ink ribbon 102 and recording paper P are pressed between a thermal head 101 and a platen roller 103 when printing is performed. The thermal head 101 is heated so that the ink of the ink ribbon 102 is transferred onto the printing paper P. At the same time, a paper conveying motor 106 rotates a pair of a capstan roller 104 and a pinch roller 105 disposed downstream in the direction of printing. The recording paper is thus conveyed and printing is performed.

After printing the first color, the thermal head 101 is separated from the platen roller 103 to print the next color as illustrated in FIG. 12B. The paper conveying motor 106 then rotates the capstan roller 104 and the pinch roller 105 in a direction opposite to the direction in printing, to return the recording paper P back to the starting position of printing. The printing of the second color and thereafter is performed by the same operation as the first color.

A mechanism for taking up the ink ribbon will be described below. Since the conveying speed of the ink ribbon during a printing operation is almost the same as that of the recording paper, the conveying speed of the ink ribbon is constant. However, the amount of ink ribbon that is conveyed increases as the diameter of the take-up bobbin of the ink ribbon increases even if the rotating speed of the take-up bobbin is controlled to be constant. In order to solve such a problem, it is a common practice to dispose a slip-type torque limiter between the take-up bobbin and the ribbon take-up motor which drives the take-up bobbin.

FIGS. 13A and 13B illustrate an example of the entire ink ribbon take-up mechanism including the torque limiter. FIG. 13A is a plan view and FIG. 13B is a side view of the mechanism.

In FIGS. 13A and 13B, a thermal head 101, an ink ribbon 102, a platen roller 103, a capstan roller 104, a pinch roller 105, and a paper conveying motor 106 are the same as those described in FIGS. 12A and 12B. A supply bobbin 111 supplies an ink ribbon that is not yet used in printing. A take-up bobbin 110 winds up an ink ribbon that is already used in printing, from the head of the ink ribbon. A ribbon take-up motor 107 drives the take-up bobbin 110. The driving force of the ribbon take-up motor 107 is transmitted to the take-up bobbin 110 through a reduction gear train 108 and a torque limiter 109.

The torque limiter 109 includes an input gear 109*a*, an output gear 109*b*, and a slip member 109*c*, which transmits rotation from the input gear 109*a* to the 109*b* by friction. The slip member 109*c* is formed by a low-friction and high-durability material such as felt. A spring member 109*d* generates frictional force by pressing the input gear 109*a* onto the output gear 109*b* via the slip member 109*c* and determines the slip torque.

As described above, the conveying speed of the ink ribbon 102 in a printing operation is almost the same as the conveying speed of the printing paper P and is constant. Therefore, as the ribbon take-up progresses and the diameter of the take-up bobbin 110 increases, the rotation speed of the take-up bobbin 110 must be decreased in order to keep the peripheral speed constant.

The torque limiter 109 is disposed on the reduction gear train 108 to absorb the above-described difference in speed. The rotation speed of the ribbon take-up motor 107 is set to rotate the input gear 109*a* at a higher speed than the rotation speed of the output gear 109*b*, which corresponds to the maximum rotation speed of the take-up bobbin 110 having a small diameter at the time of start. As a result, the rotation speed of the input gear 109*a* adequately exceeds the output gear 109*b*. The rotation speed of the input gear 109*a* exceeds the output gear 109*b* from the beginning of the ribbon take-up, all the time up to when the rotation speed of the bobbin 110 decreases as the take-up progresses and the diameter increases. The difference in speed is absorbed by making the torque limiter 109 slip, and consequently, the ink ribbon is taken up smoothly. Japanese Patent Application Laid-Open Nos. 8-174979 and 9-174973, and Japanese Patent No. 3091401 discuss such a generally-used torque limiter mechanism and operation.

In such a ribbon take-up mechanism, a slack in the ink ribbon can be generated when conveying of an ink ribbon is stopped. The slack is caused by the inertia of the bobbin. A slack in the ink ribbon can be generated also when the platen roller is separated from the contact with the thermal head.

A slack in the ink ribbon can cause various problems. For example, recording paper can contact a slackening ink ribbon and cause paper jams. A slack can also cause the ink ribbon to be wrinkled and lead to an image defect. Moreover, if there is a large slack, a user can jam a part of the apparatus with the slackening ink ribbon when the user detaches the ink ribbon cassette. In general, a slack in the ink ribbon can lead to a failure in the apparatus or an image defect so that the reliability of the apparatus is degraded.

Furthermore, when the recording paper is conveyed so close to a stationary ink ribbon during a printing operation that the recording paper contacts the stationary ink ribbon, the ink ribbon can stick onto the recording paper due to static electricity. This can cause jamming of the ink ribbon and the recording paper, or the ink ribbon can be entangled with the paper feed roller. Therefore, it is necessary to convey the recording paper at an adequate distance from a stationary ink ribbon so that the apparatus becomes larger.

FIGS. 14A and 14B illustrate two configurations of pressing and separating mechanisms of the thermal head 101 and the platen roller 103. In FIG. 14A, the thermal head 101 is retracted and the platen roller 103 is fixed. Alternatively, in FIG. 14B, the thermal head 101 is fixed and the platen roller is retracted. Since both configurations have advantages and disadvantages, either configuration can be selected depending on a product. In FIG. 14A, as the thermal head 101 is retracted, the ink ribbon 102 is also retracted from the conveyance path of the recording paper. Therefore, the ink ribbon 102 and the recording paper P are set apart at an adequate distance. However, in FIG. 14B, although the platen roller 103 is retracted, the positions of the capstan roller 104 and the pinch roller 105 do not change so that the ink ribbon 102 and the recording paper P are close to each other. That is, the configuration of FIG. 14B is disadvantageous in view of the above-described problems (such as sticking and jamming) caused by the contact between the ink ribbon 102 and the recording paper P when the recording paper P is conveyed. Therefore, it is still further important to prevent slackening of the ink ribbon 102 in the configuration of FIG. 14B.

Japanese Patent Application Laid-Open Nos. 5-193221, 7-148952, 7-125396, 7-314833, 9-207417, and 10-119400 discuss various techniques for minimizing the slackening of the ink ribbon that causes the above-described problems. However, such techniques cannot totally remove slackening of the ink ribbon. Therefore, when recording paper is conveyed close to a stationary ink ribbon, the recording paper can stick onto the ink ribbon, or a jam can occur.

SUMMARY OF THE INVENTION

The present invention is directed to a recording apparatus in which an ink ribbon and recording paper is prevented from sticking or jamming when the recording paper is conveyed near a stationary ink ribbon.

According to an aspect of the present invention, a recording apparatus includes a supply bobbin configured to supply an ink ribbon, a take-up bobbin configured to wind up an ink ribbon supplied by the supply bobbin, a take-up bobbin driving unit for driving the take-up bobbin, a recording head configured to transfer ink of the ink ribbon onto recording paper, a platen roller configured to pinch the ink ribbon and the recording paper together with the recording head, a conveying unit configured to convey the recording paper between the recording head and the platen roller, a separating unit configured to separate the recording head and the platen roller, and a control unit configured to control the separating unit to separate the recording head and the platen roller, and control the conveying unit to convey the recording paper while the take-up bobbin driven by the take-up bobbin driving unit applies a tensile force to the ink ribbon when the recording paper is moved between the recording head and the platen roller without transferring ink of the ink ribbon.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DETAILED DESCRIPTION OF THE EMBODIMENTS

Various exemplary embodiments, features, and aspects of the invention will be described in detail below with reference to the drawings.

First Exemplary Embodiment

Figure 1:
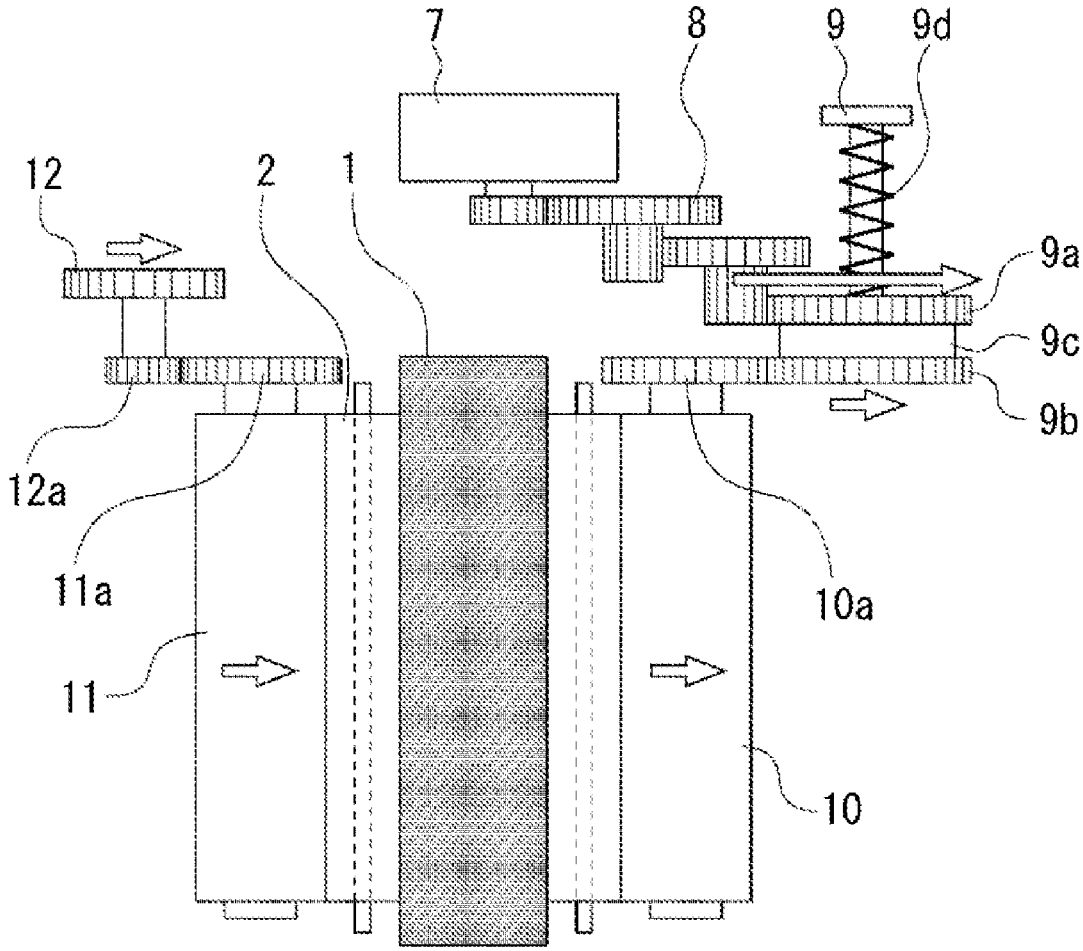
FIG. 1 is a plan view of a recording apparatus according to a first exemplary embodiment of the present invention.
Figure 2:
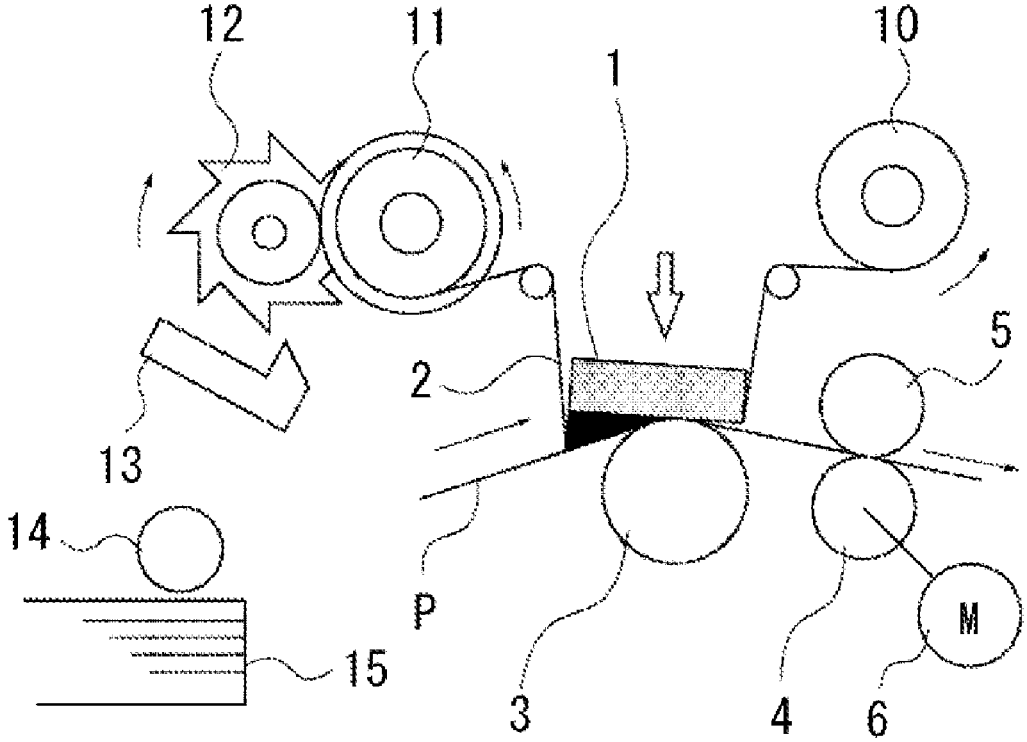
FIG. 2 is a side view of a recording apparatus according to a first exemplary embodiment of the present invention.

FIGS. 1 and 2 are a plan view and a side view of a recording apparatus, respectively, which includes an ink ribbon (ink sheet) take-up mechanism according to a first exemplary embodiment of the present invention.

In FIGS. 1 and 2, the recording apparatus includes a thermal head 1 serving as a recording head, an ink ribbon 2, a platen roller 3, a capstan roller 4, and a pinch roller 5.

A heating portion (i.e., a plurality of heating elements) that is arranged linearly is formed on the thermal head 1. Ink of the ink ribbon 2 is transferred onto the recording paper P by heating the heating elements in accordance with image information. The platen roller 3 is disposed opposite and parallel to the heating unit of the thermal head 1. The platen roller 3 and the thermal head 1 switch between states of pressing against each other and being separated from each other.

The recording paper P is conveyed by the capstan roller 4 (conveying unit), which is driven by a paper conveying motor 6. The recording paper P is conveyed along a recording paper conveyance path, which runs between the thermal head 1 and the platen roller 3. The recording paper P is conveyed and pressed against the thermal head 1 by the platen roller 3, and ink is thermally transferred from the ink ribbon 2 to the recording paper P heated by the thermal head 1 in accordance with the image information. An image is thus formed on the recording paper P. The platen roller 3 is supported to rotate freely without being driven and rotates in accordance with the recording paper P conveyed by the capstan roller 4.

A plurality of color regions on which each color of ink is coated is formed on the ink ribbon 2. The plurality of color regions is arranged repeatedly in a predetermined order in the conveying direction of the ink ribbon 2. A thermal transfer from each color region of the ink ribbon 2 is performed sequentially onto the same recording paper P to form a color image on the recording paper P.

A supply bobbin 11 supplies unused ink ribbon, and a take-up bobbin 10 winds up the used ink ribbon. The take-up bobbin 10 is driven by a ribbon take-up motor 7 (i.e., a take-up bobbin driving unit). The driving force of the ribbon take-up motor 7 is transmitted through a reduction gear train 8 and a torque limiter 9 to a bobbin gear 10*a*, which is provided on the take-up bobbin 10. A rotary shaft of the torque limiter 9 is supported coaxially with the take-up bobbin 10. The take-up bobbin 10 is thus driven.

The torque limiter 9 includes an input gear 9*a*, an output gear 9*b*, and a slip member 9*c*. The slip member 9*c* can be formed by a low-friction and high-durability material such as felt, and transmits rotation from the input gear 9*a* to the output gear 9*b* by friction. A spring member 9*d* generates frictional force by pressing the input gear 9*a* onto the output gear 9*b* via the slip member 9*c*, and determines the slip torque.

A supply bobbin gear 11*a* is fixed on the rotary shaft of the supply bobbin 11. A ratchet gear 12*a* is fixed on the rotary shaft of a ratchet plate 12 and gears with the supply bobbin gear 11*a*.

An engaging member 13 switches between states of engaging with the ratchet plate 12 to stop the rotation of the supply bobbin 11, and disengaging from the ratchet plate 12 so that the supply bobbin 11 rotates freely. The switching between the engaged and disengaged states is performed by an engaging member switching unit such as a solenoid, which will be described later.

A paper feeding roller 14 feeds the recording paper stored in a cassette 15 toward the thermal head 1.

FIG. 1 illustrates a recording apparatus in a printing state. The platen roller 3 is pressed against the thermal head 1, and the engaging member 13 is in a disengaged state in which the supply bobbin 11 rotates freely. When printing is performed in the above state, the torque limiter 9 slips just as in the conventional apparatus to absorb the change in the rotation speed caused by the change in the diameter of the take-up bobbin 10. Consequently, the ink ribbon 2 is taken up smoothly.

Figure 3:
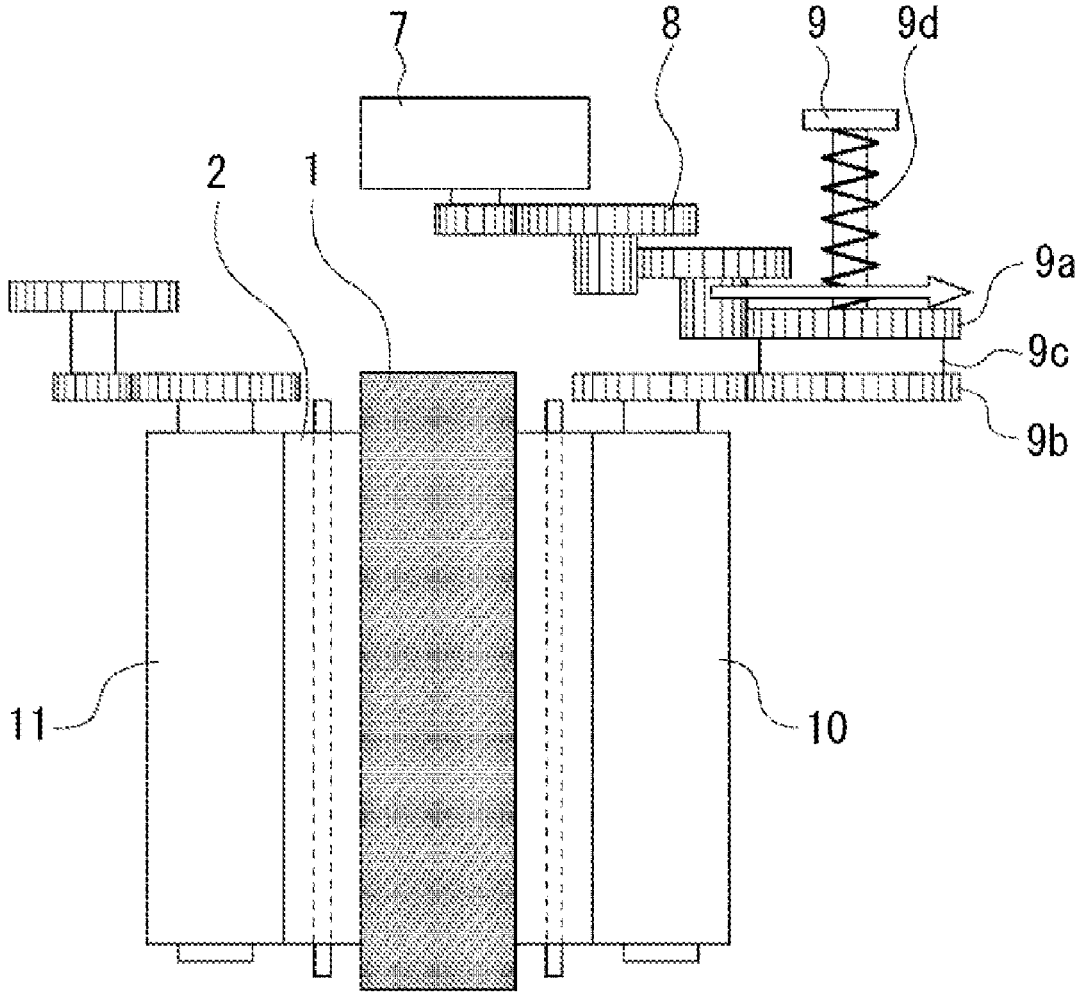
FIG. 3 is a plan view of a recording apparatus according to a first exemplary embodiment of the present invention.
Figure 4:
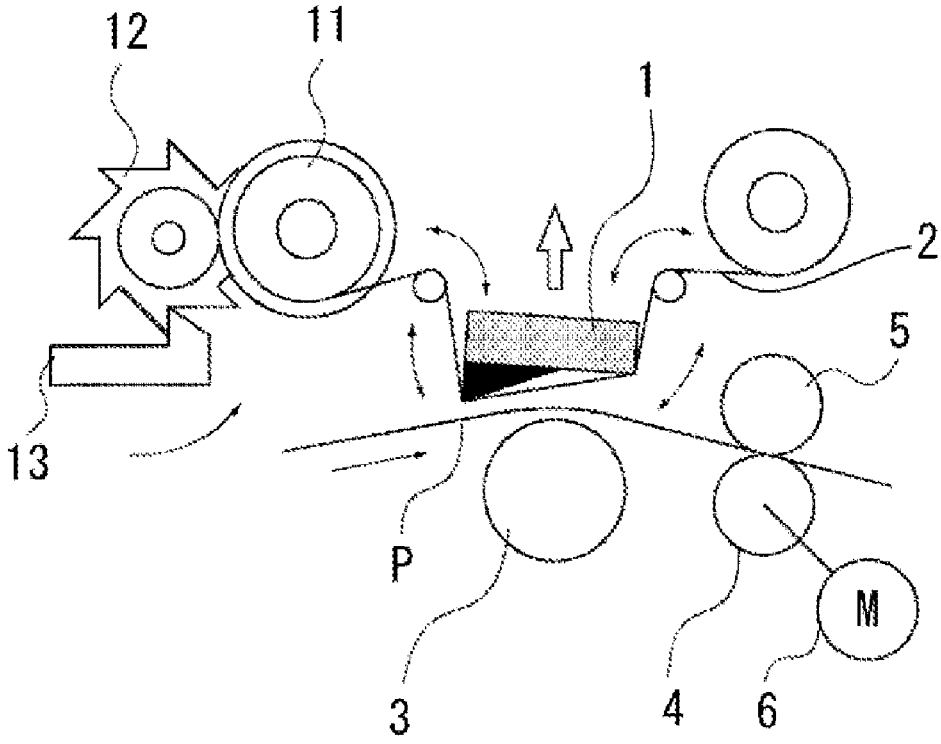
FIG. 4 is a side view of a recording apparatus according to a first exemplary embodiment of the present invention.

FIGS. 3 and 4 illustrate a recording apparatus when a slack in the ink ribbon 2 is to be removed.

The platen roller 3 is separated from the thermal head 1, and the engaging member 13 is engaged with the ratchet plate 12 to stop the rotation of the supply bobbin 11. When the ink ribbon take-up motor 7 is driven in the ribbon take-up direction, the input gear 9*a* of the torque limiter 9 rotates. However, since the supply bobbin 11 cannot rotate, the ink ribbon 2 is not supplied, and the take-up bobbin 10 and the output gear 9*b* cannot rotate either. As a result, the slip torque of the torque limiter 9 constantly applies tensile force to the ink ribbon 2 so that a tension state is maintained.

When printing is not performed and the recording paper P is conveyed between the ink ribbon 2 and the platen roller 3 while the ink ribbon 2 is maintained in the tension state as above described, the ink ribbon 2 does not contact and stick to the recording paper P and become jammed. Since the ink ribbon 2 is placed under the tension, the ink ribbon 2 does not stick to the recording paper P even if the recording paper P contacts the ink ribbon 2. Japanese Patent Application Laid-Open No. 5-193221 discusses conveying of recording paper that contacts an ink ribbon while only a bobbin is locked without actively removing a slack. Compared to such technique, the present exemplary embodiment provides a higher reliability in preventing sticking of the recording paper and the ink ribbon, or jamming.

Figure 5:
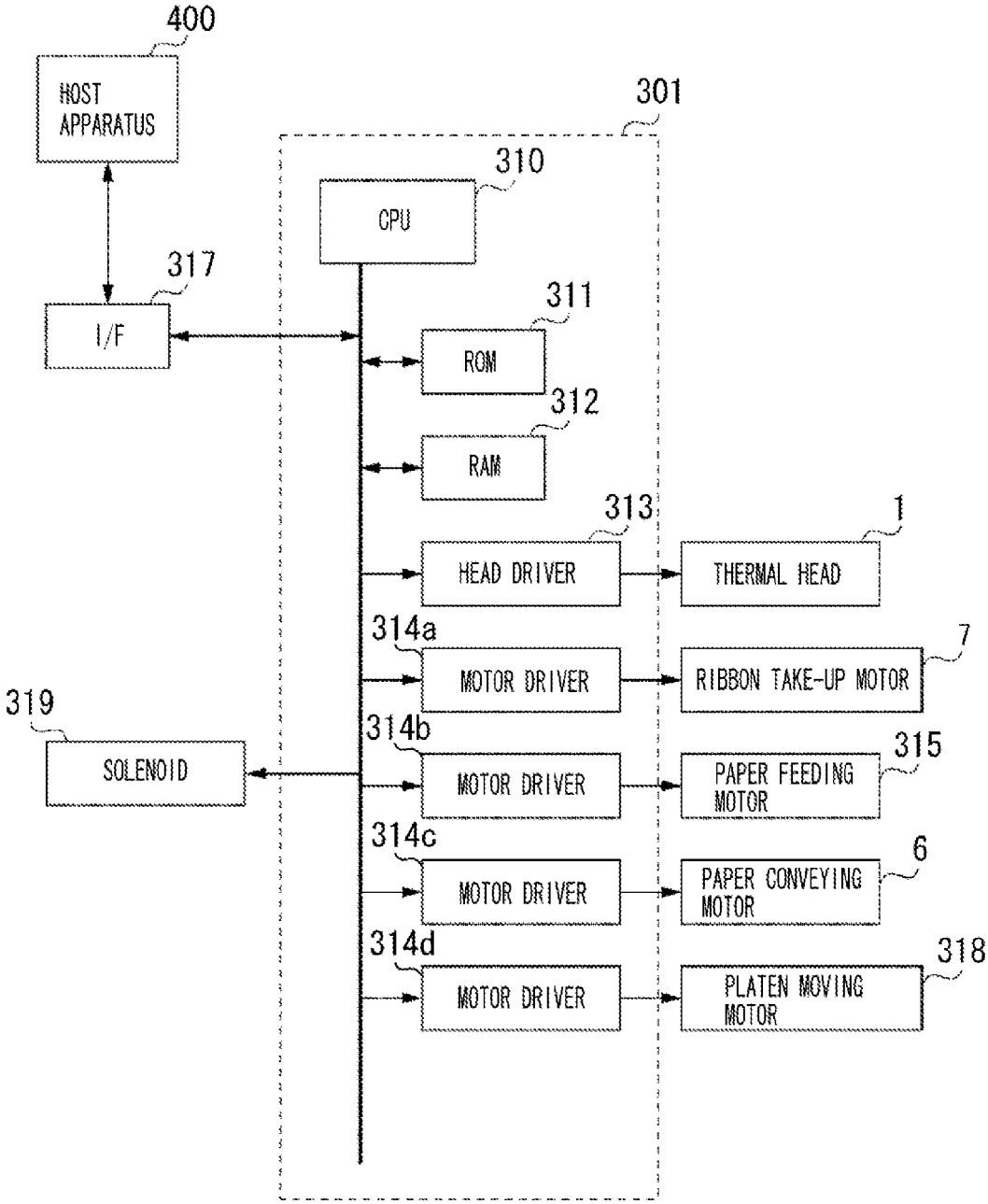
FIG. 5 is a block diagram illustrating control of a recording apparatus according to a first exemplary embodiment of the present invention.

FIG. 5 is a block diagram illustrating control of a recording apparatus according to the first exemplary embodiment.

In FIG. 5, a control circuit board 301 controls the recording apparatus. The control circuit board 301 includes a central processing unit (CPU) 310 which gives various control commands, a read-only memory (ROM) 311 in which control data is written, and a random access memory (RAM) 312 which is an area for expanding recorded data.

A head driver 313 drives the thermal head 1. A ribbon take-up motor 7 drives the take-up bobbin 10 which winds up the ink ribbon 2. A paper feeding motor 315 drives the paper feeding roller 14. Each of the motor drivers 314*a*, 314*b*, 314*c*, and 314*d* drives the ribbon take-up motor 7, the paper feeding motor 315, the paper conveying motor 6, and a platen moving motor 318.

The platen moving motor 318 presses and separates the platen roller 3 onto and from the thermal head 1, and is configured as a head-platen switching unit or a separating unit. A solenoid 319 engages and disengages the engaging member 13 with and from the ratchet plate 12, and is configured as an engaging member switching unit.

An interface 317 sends and receives data to and from a host apparatus 400 such as a digital camera.

The operation of the recording apparatus will be described using FIGS. 1 to 5 and flowcharts in FIGS. 6 and 7.

Figure 6:
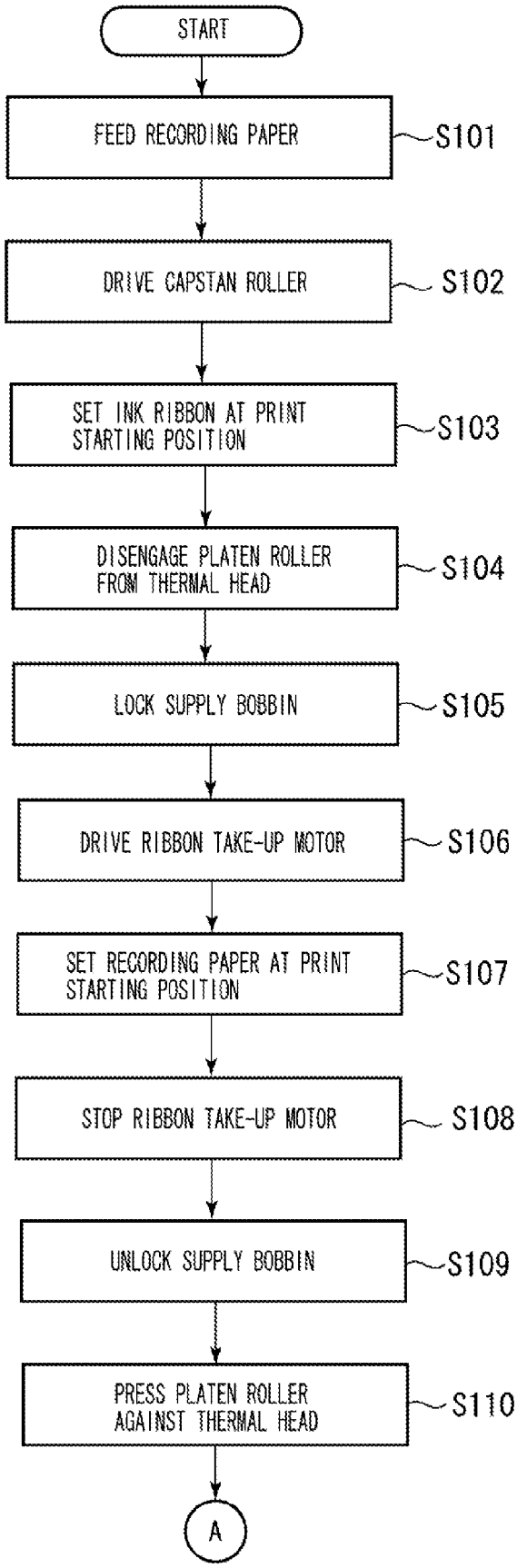
FIG. 6 is a control flow chart of a recording apparatus according to a first exemplary embodiment of the present invention.

In step S101 of FIG. 6, the CPU 310 controls the paper feeding motor 315 to drive the paper feeding roller 314 to feed one piece of recording paper P from the cassette 15. In step S102, the CPU 310 controls the paper conveying motor 6 to drive the capstan roller 4. In step S103, the CPU 310 controls the ribbon take-up motor 7 to rotate the take-up bobbin 10 so that the ink ribbon 2 is set at a print starting position.

In step S104, the CPU 310 drives the platen moving motor 318 to separate the platen roller 3 from the thermal head 1.

In step S105, the CPU 310 controls the solenoid 319 to engage the engaging member 13 with the ratchet plate 12 to lock the supply bobbin 11 against rotating.

In step S106, the CPU 310 drives the ribbon take-up motor 7. The driving force of the ribbon take-up motor 7 is transmitted through the torque limiter 9 to the take-up bobbin 10, and a tensile force is applied to the ink ribbon 2. The above-described operation is completed before the recording paper P reaches the thermal head 1.

In step S107, the CPU 310 performs control so that the recording paper P is conveyed to a print starting position while the ribbon take-up motor 7 is driven and the ink ribbon 2 is under a tension as shown in FIGS. 3 and 4. A process of placing the printing paper P at a starting position is thus completed.

In step S108, the CPU 310 stops the ribbon take-up motor 7. In step S109, the CPU 310 turns off the solenoid 319 so that the engaging member 13 is disengaged from the ratchet plate 12 and the supply bobbin 11 is unlocked.

In step S110, the CPU 310 drives the platen moving motor 318 to move the platen roller 3. Consequently, the ink ribbon 2 and the recording paper P are pinched between the thermal head 1 and the platen roller 3.

Figure 7:
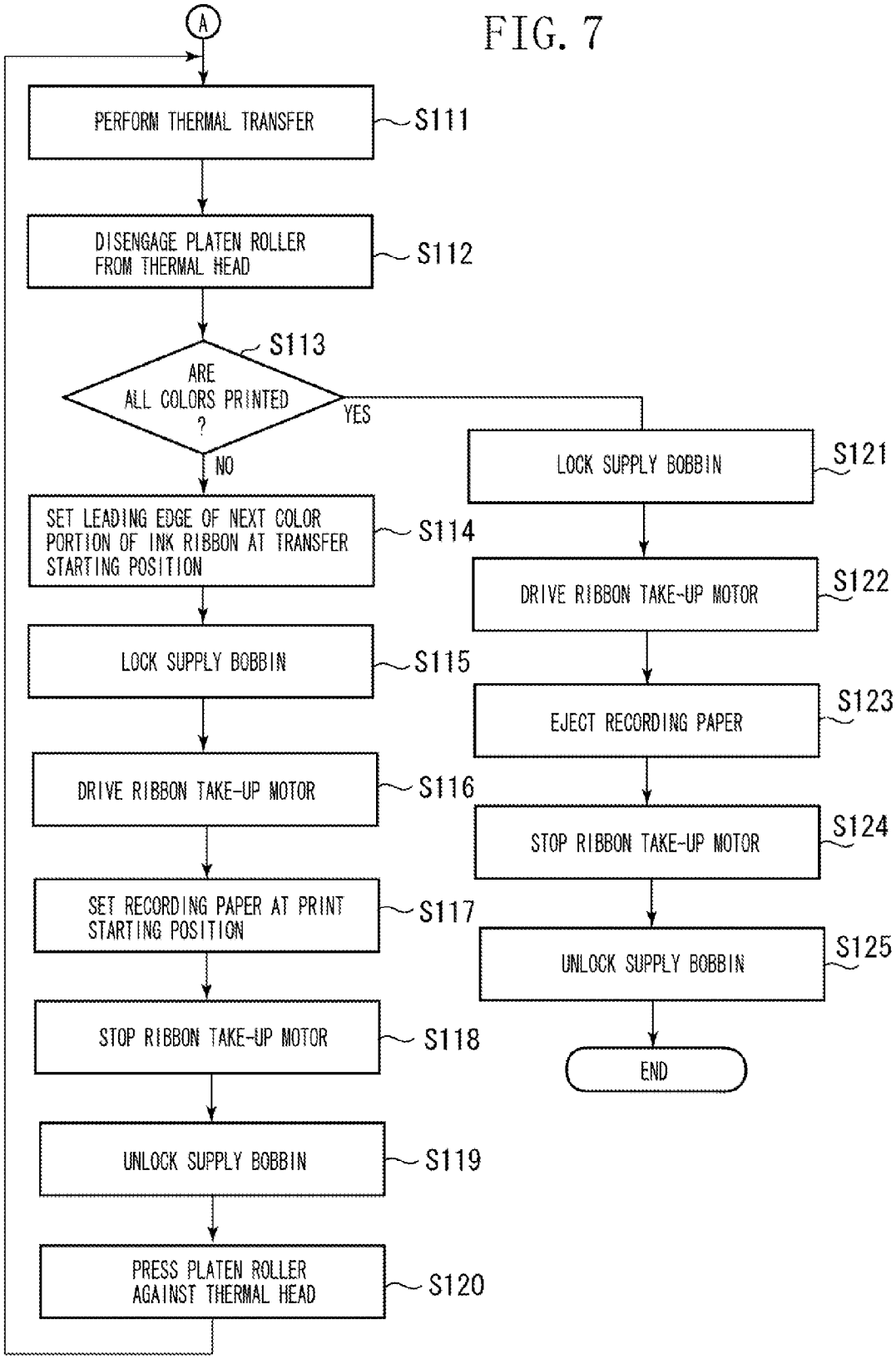
FIG. 7 is a flow chart illustrating control of a recording apparatus according to a first exemplary embodiment of the present invention.

In step S111 of FIG. 7, the CPU 310 drives the ribbon take-up motor 7 and the paper feeding motor 6 to convey the ink ribbon 2 and the recording paper P as shown in FIGS. 1 and 2. At the same time, the CPU 310 controls the heating elements in the thermal head 1 to heat in accordance with recording information. The ink of the ink ribbon 2 is thus transferred to the recording paper P to form an image. Since the ink ribbon 2 and the recording paper are pinched by the thermal head 1 and the platen roller 3, the ink ribbon 2 and the recording paper P move together. Although the ink ribbon 2 is pulled downstream by the take-up bobbin 10, the ink ribbon 2 moves at the same speed as the recording paper P because the ink ribbon 2 is pressed against the recording paper P.

After the ink transfer is performed up to the end of the recording paper P, the CPU 310 drives the platen moving motor 318 to move the platen roller 3 away from the thermal head 1 in step S112.

A plurality of color ink is coated in a predetermined order in the longitudinal direction of the ink ribbon 2. Each color is transferred sequentially from the ink ribbon 2 to the recording paper P. In step S113, the CPU 310 determines whether all colors of the ink ribbon 2 have been transferred. When there is a color to be transferred (NO in step S113), the process proceeds to step S114. In step S114, the CPU 310 drives the take-up bobbin 10 to move the ink ribbon 2 so that the head of the next color region to be transferred reaches the starting position of the transfer.

In step S115, the CPU 310 controls the solenoid 319 to engage the engaging member 13 with the ratchet plate 12 and lock the supply bobbin 11. In step S116, the CPU 310 drives the ribbon take-up motor 7 to apply a tensile force to the ink ribbon 2. In step S117, the CPU 310 controls the paper feeding motor 6 to rotate the capstan roller 4 in reverse. The recording paper P is thus moved in a direction opposite to the conveying direction to reach the print starting position.

When the recording paper P reaches the print starting position, the CPU 310 stops the ribbon take-up motor 7 in step S118. In step S119, the CPU 310 turns off the solenoid 319 so that the engaging member 13 is disengaged from the ratchet plate 12 and the supply bobbin 11 is unlocked.

In step S120, the CPU 310 drives the platen moving motor 318 to move the platen roller 3, and the ink ribbon 2 and the recording paper P are pinched between the thermal head 1 and the platen roller 3. The process then returns to step S111 and ink transfer is performed. After the transfer is completed, the CPU 310 separates the platen roller 3 from the thermal head 2 in step S112. In step S113, the CPU 310 determines whether all colors have been transferred.

If all colors have been transferred (YES in step S113), the process proceeds to step S121. In step S121, the CPU 310 controls the solenoid 319 to engage the engaging member 13 with the ratchet plate 12 and lock the supply bobbin 11. In step S122, the CPU 310 drives the ribbon take-up motor 7 to apply a tensile force to the ink ribbon 2 while the supply bobbin 11 is locked. In step S123, the paper feeding motor 6 drives the capstan roller 4, and the recording paper P is ejected from the recording apparatus.

In step S124, the CPU 310 stops the ribbon take-up motor 7. In step S125, the CPU 310 turns off the solenoid 319 so that the engaging member 13 is disengaged from the ratchet plate 12 and the supply bobbin 11 is unlocked.

Under the above described control, a tensile force is always applied to the ink ribbon 2 to eliminate a slack when the recording paper P is passed through the ink ribbon 2 and the platen roller 3. As a result, the ink ribbon 2 is prevented from slackening and sticking to the recording paper P, or causing the jamming of the ribbon 2 or the paper P.

According to the present embodiment, a recording apparatus conveys recording paper P while the slip torque of the torque limiter 9 applies a tensile force to the ink ribbon 2. As a result, the reliability of the recording apparatus increases as compared to conventional techniques in the case where the recording paper P is conveyed while contacting an ink ribbon. Consequently, the space through which the recording paper is passed through, i.e., the separating distance between the thermal head 1 and the platen roller 3 can be significantly minimized. Therefore, the apparatus can become more compact. Moreover, since the distance between the thermal head 1 and the platen roller 3 is decreased, the power of the motor for driving the pressing-separating switching unit can be decreased.

Figure 14A:
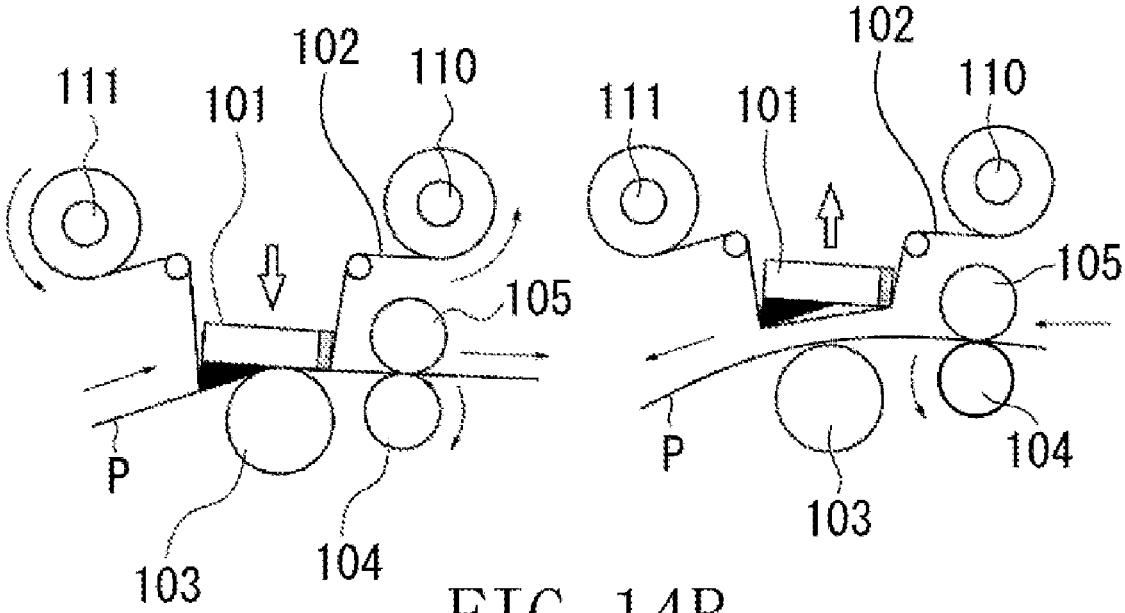
FIGS. 14A and 14B are side views of a conventional printing apparatus.
Figure 14B:
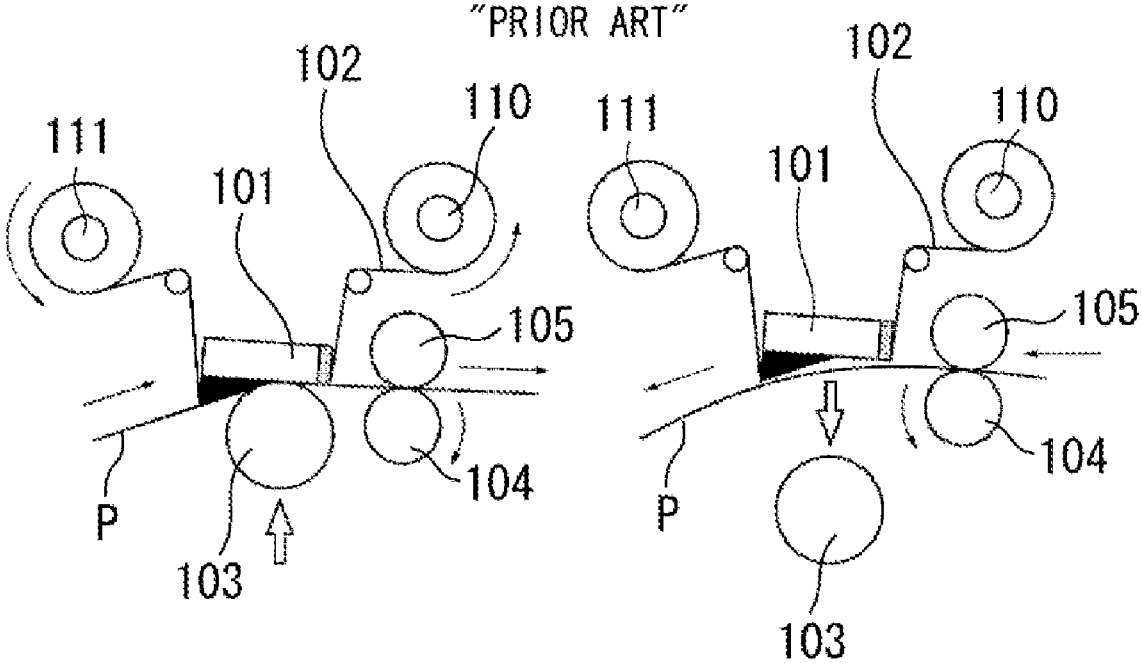

Furthermore, as described above, the recording paper can be conveyed closer to the ink ribbon when the thermal head is fixed and the platen roller is retracted as shown in FIG. 14B, as compared to the case where the thermal head is retracted and the platen roller is fixed as shown in FIG. 14A. Therefore, the present exemplary embodiment is more effective in the configuration illustrated in FIG. 14B in which the thermal head is fixed and the platen roller is retracted.

Other Exemplary Embodiments

Figure 8:
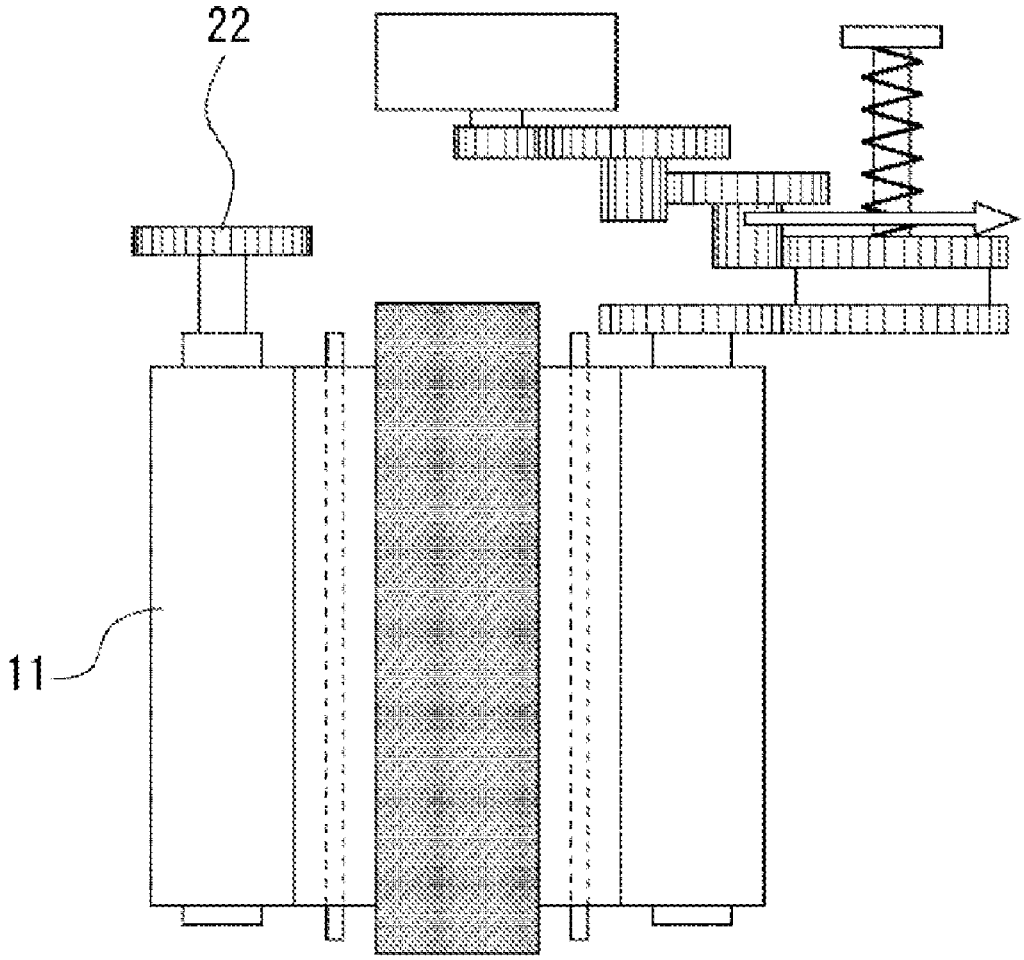
FIG. 8 is a plan view of a recording apparatus according to a second exemplary embodiment of the present invention.

FIG. 8 illustrates a second exemplary embodiment of the present invention. In the first exemplary embodiment, the ratchet plate 12 is fixed coaxially with the ratchet gear 12*a*, which gears with the supply bobbin gear 11*a* that is fixed on the rotary shaft of the supply bobbin 11. The ratchet plate 12 thus acts indirectly on the supply bobbin 11. In FIG. 8, a ratchet member 22 (i.e., a rotating body) is arranged coaxially with the supply bobbin 11. Therefore, the ratchet member 22 acts directly on the supply bobbin 11. The result achieved in the first exemplary embodiment can also be achieved in the above configuration.

Figure 9:
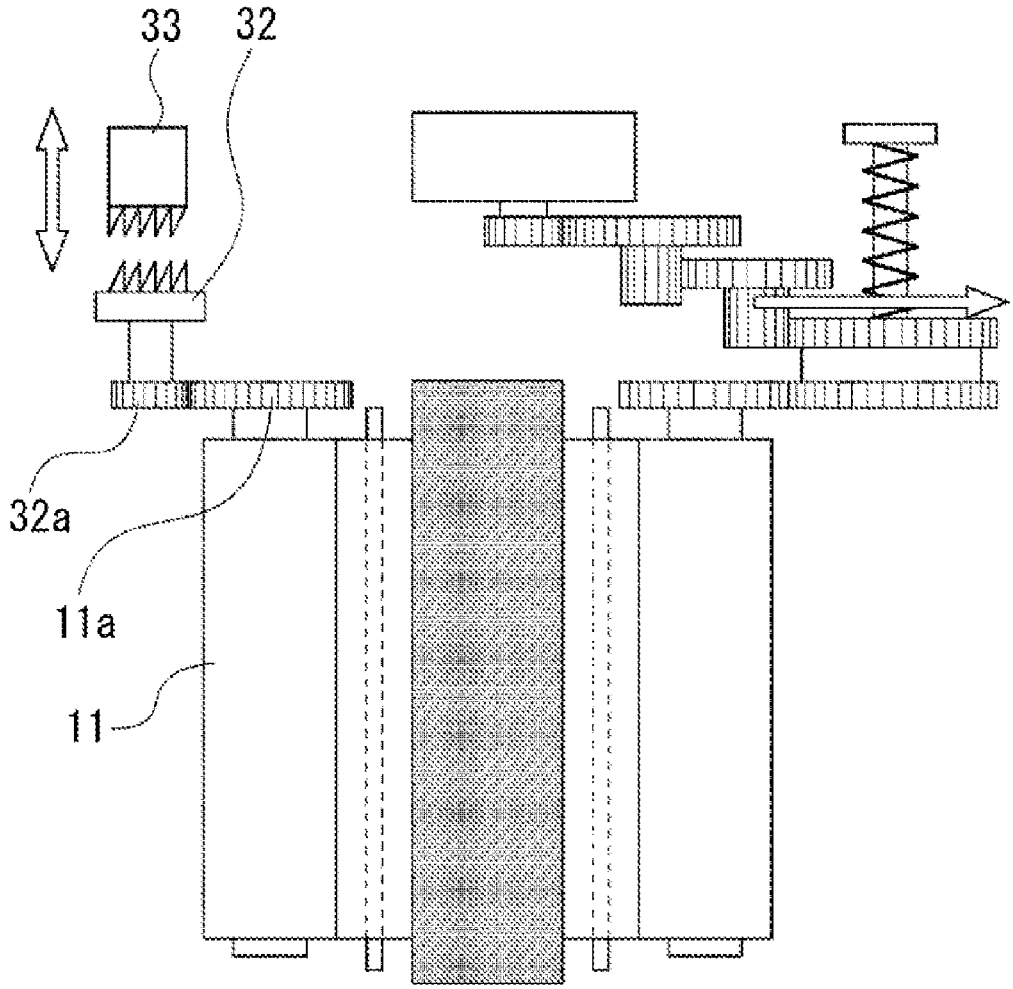
FIG. 9 is a plan view of a recording apparatus according to a third exemplary embodiment of the present invention.

FIG. 9 illustrates a third exemplary embodiment of the present invention. In FIG. 9, a ratchet 32 includes a plurality of gear teeth protruding in the axial direction. A ratchet gear 32*a* is geared with a supply bobbin gear 11*a*. An engaging member 33 moves in the longitudinal direction of the supply bobbin 11 and engages with the supply bobbin 11. The result achieved in the first exemplary embodiment can also be achieved in the above configuration.

Figure 10:
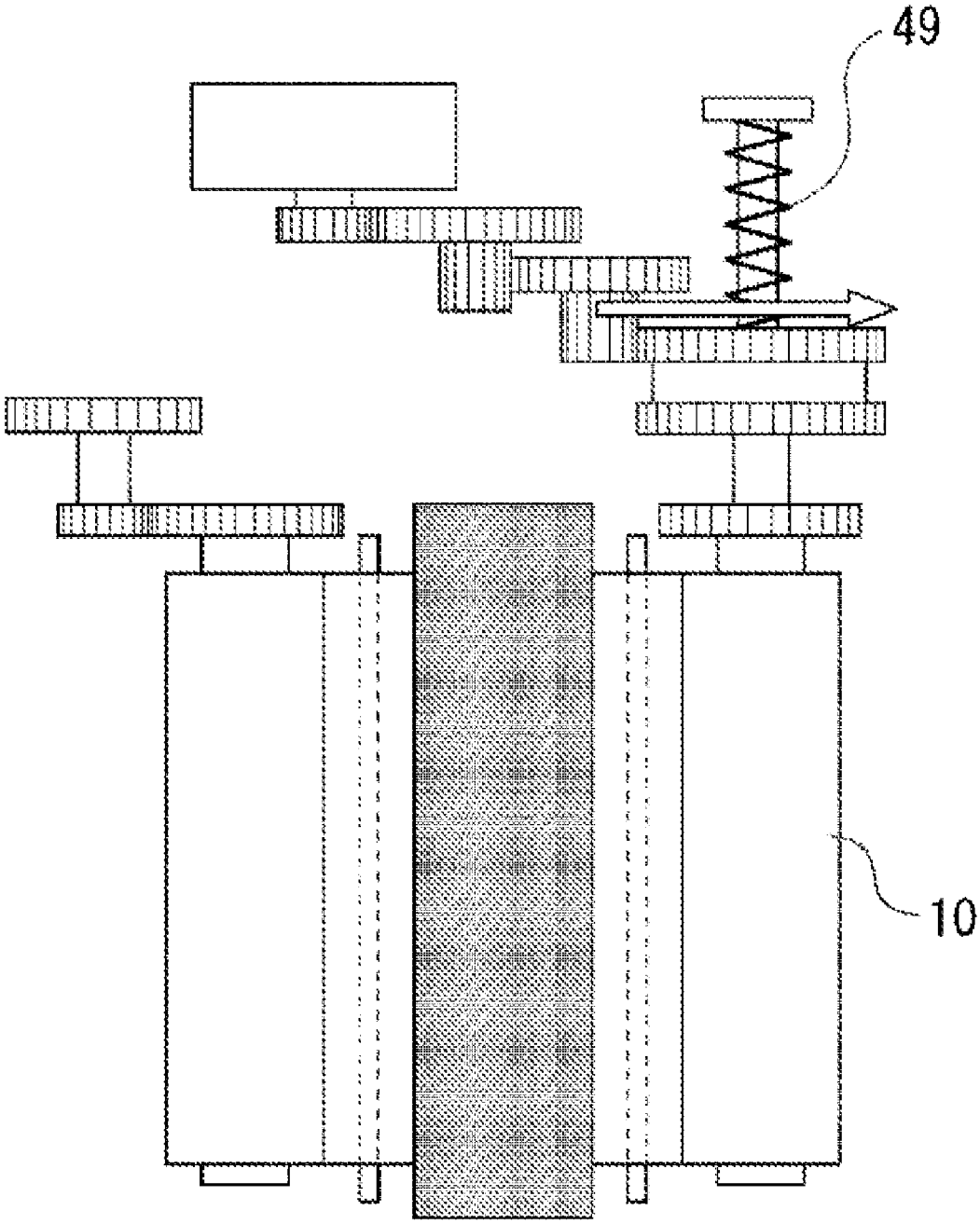
FIG. 10 is a plan view of a recording apparatus according to a fourth exemplary embodiment of the present invention.

FIG. 10 illustrates a fourth exemplary embodiment of the present invention. In FIG. 10, a torque limiter 49 is arranged coaxially with the take-up bobbin 10. The result achieved in the first exemplary embodiment can also be achieved in the above configuration.

Figure 11:
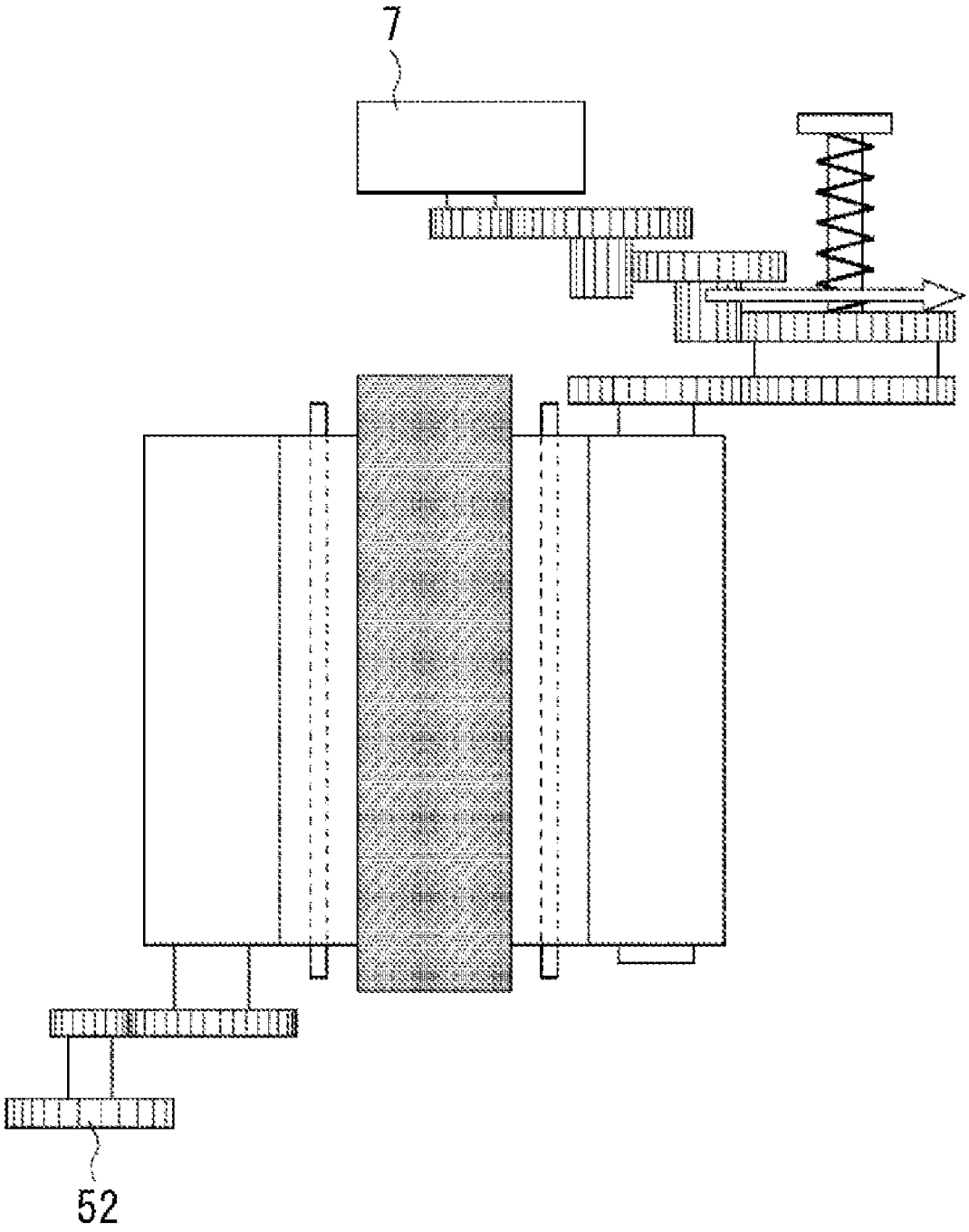
FIG. 11 is a plan view of a recording apparatus according to a fifth exemplary embodiment of the present invention.
Figure 12A:
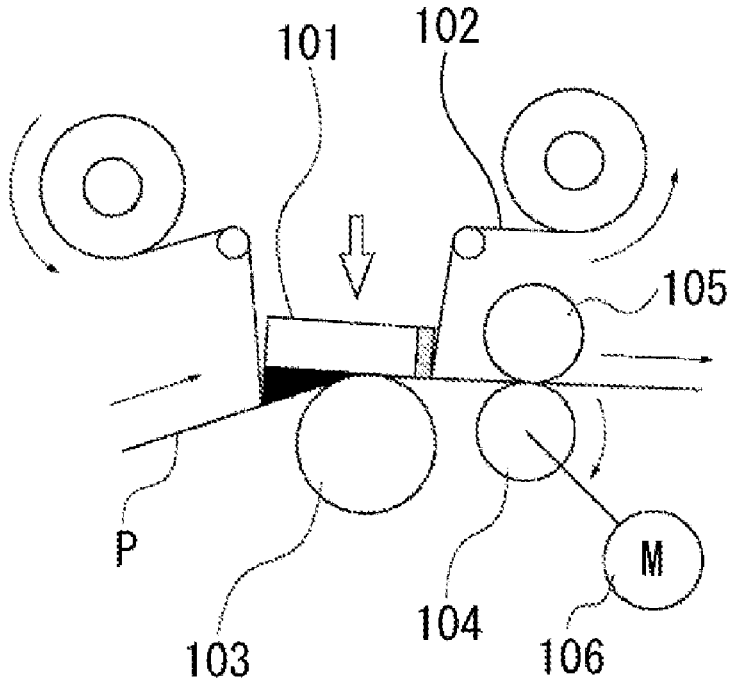
FIGS. 12A and 12B are side views of a conventional printing apparatus.
Figure 12B:
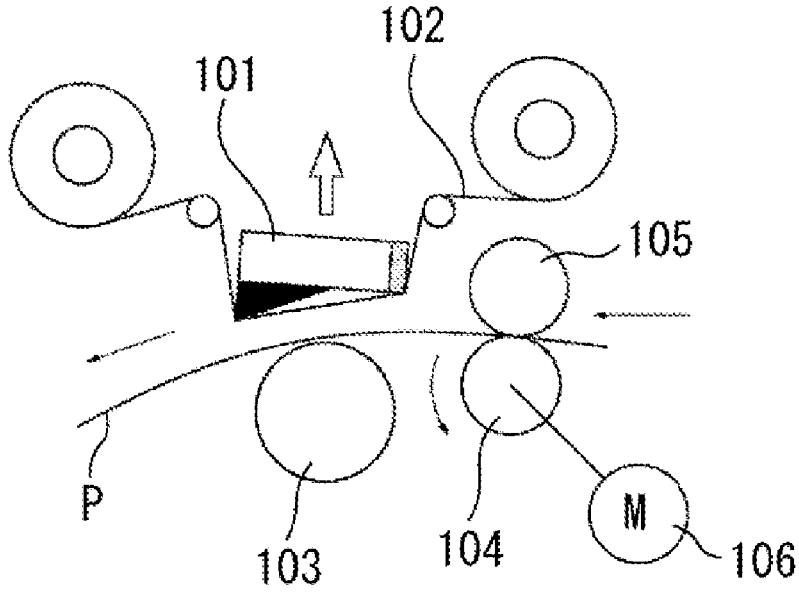
Figure 13A:
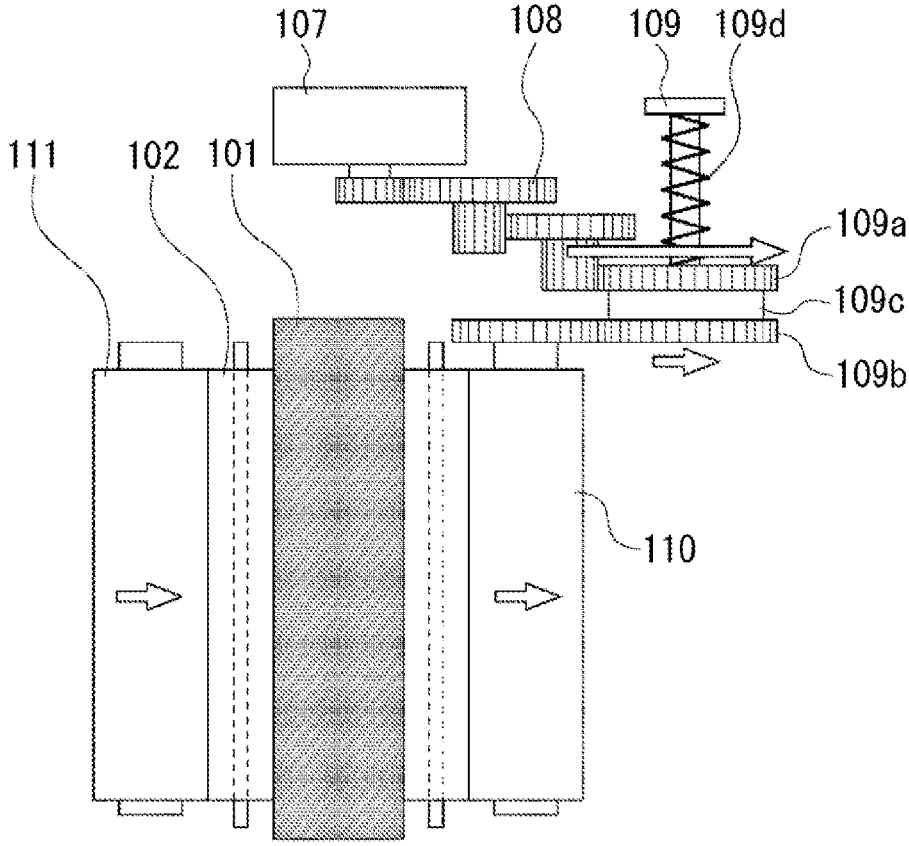
FIGS. 13A and 13B are a plane view and a side view of a conventional printing apparatus.
Figure 13B:
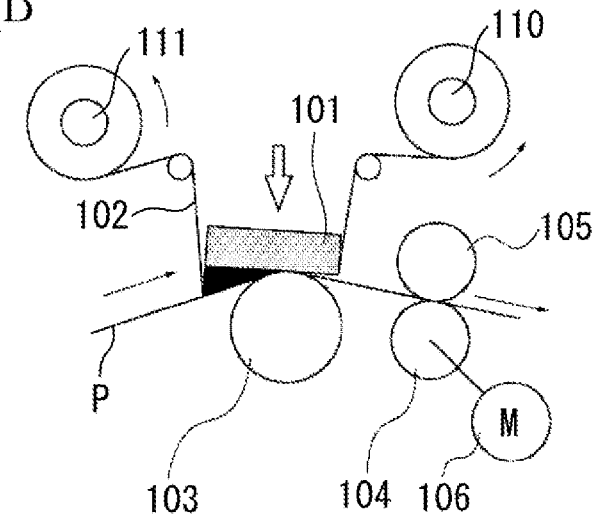

FIG. 11 illustrates a fifth exemplary embodiment of the present invention. Similar to FIG. 10, the ratchet member 52 is arranged on the side opposite to the ribbon take-up motor 7. The result achieved in the first exemplary embodiment can also be achieved in the above configuration.

According to the above-described exemplary embodiments, a recording apparatus conveys recording paper while a slip torque of a torque limiter constantly applies a tensile force to an ink ribbon. Consequently, the reliability in conveying the recording paper, while the recording paper is in contact with an ink ribbon, is increased as compared to a conventional apparatus.

In addition, the space through which the recording paper is conveyed, i.e., the separating distance between a thermal head and a platen roller can be minimized. Therefore, the size of the apparatus can be significantly reduced.

Moreover, by decreasing the above separating distance between the thermal head and the platen roller, the power of the motor for driving a switching unit, which switches the thermal head and the platen roller between pressing and separating, can be decreased.

Furthermore, the present invention is more effective in a configuration in which the thermal head is fixed and the platen roller is retracted.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2006-230157 filed Aug. 28, 2006, which is hereby incorporated by reference herein in its entirety.

What is claimed is:

1. A recording apparatus comprising:

a thermal head including a heating portion in which a plurality of heating elements are linearly arranged;

an ink ribbon on which ink is coated;

a platen roller disposed opposite and parallel to the heating portion of the thermal head;

a separating unit configured to separate the thermal head and the platen roller;

a paper feed driving motor;

a ribbon take-up motor;

a torque limiter which can be driven and rotated by the ribbon take-up motor;

a take-up bobbin which can be driven and rotated by the torque limiter and is configured to wind up used ink ribbon, and the torque limiter transmits a drive force of the ribbon take-up motor to the take-up bobbin;

a supply bobbin configured to supply unused ink ribbon;

a ratchet configured to act directly and indirectly on the supply bobbin, wherein the ratchet turns in conjunction with the take-up bobbin;

an engaging member movable between an engaging state in which rotation of the supply bobbin is stopped by the engaging member engaging with the ratchet, and a disengaged state in which the supply bobbin is free to rotate;

an engaging member switching unit configured to switch the engaging member between the engaging state and the disengaging state; and a control unit configured to control the separating unit to separate the thermal head and the platen roller, and control the recording apparatus to convey the recording paper while the engaging member is in the engaging state to prevent the supply bobbin from rotation, and control the ribbon take-up motor to be driven in the direction in which the ink ribbon is taken up such that the torque limiter transmits a drive force of the ribbon take-up motor to the take-up bobbin while skidding when the recording paper is moved between the thermal head and the platen roller without transferring ink of the ink ribbon.

2. The recording apparatus according to claim 1, wherein the position of the thermal head in the recording apparatus remains the same between when the printing operation is performed and when the printing operation is not performed.

3. The recording apparatus according to claim 1, wherein the platen roller can move between a pressing state in which the platen roller is pressed onto the thermal head and a separated state in which the platen roller is separated from the thermal head, and wherein the head-platen switching unit acts on the platen roller to switch between a pressed state and a separated state.

4. The recording apparatus according to claim 1, wherein the ratchet is a rotating body having a rotary shaft supported coaxially on the supply bobbin.

5. The recording apparatus according to claim 1, wherein the engaging member can move in a direction perpendicular to the direction of a rotation central axis of the supply bobbin.

6. The recording apparatus according to claim 1, wherein the engaging member can move in a direction parallel to the direction of a rotation central axis of the supply bobbin.

7. The recording apparatus according to claim 1, wherein the torque limiter has a rotary shaft supported coaxially on the take-up bobbin.

8. The recording apparatus according to claim 1, wherein the ratchet is disposed on the same side as the ribbon take-up motor relative to a conveyance path of the recording paper.

9. The recording apparatus according to claim 1, wherein the ratchet is disposed on a side opposite to the ribbon take-up motor relative to a conveyance path of the recording paper.

10. A recording apparatus comprising:

a supply bobbin configured to supply an ink ribbon;

a locking unit locking the supply bobbin to prevent the supply bobbin from rotating;

a take-up bobbin configured to wind up an ink ribbon supplied from the supply bobbin;

a take-up bobbin driving unit configured to drive the take-up bobbin, wherein the take-up bobbin driving unit includes a torque limiter configured to transmit a drive force of a drive source to the take-up bobbin;

a recording head configured to transfer ink of the ink ribbon onto recording paper;

a platen roller configured to pinch the ink ribbon and the recording paper together with the recording head;

a conveying unit configured to move the recording paper between the recording head and the platen roller;

a separating unit configured to separate the recording head and the platen roller; and a control unit configured to control the separating unit to separate the recording head and the platen roller, and control the conveying unit to convey the recording paper while the take-up bobbin driven by the take-up bobbin driving unit applies a tensile force to the ink ribbon in a state that the supply bobbin is locked by the locking unit when the recording paper is moved between the recording head and the platen roller without transferring ink of the ink ribbon.

11. The recording apparatus according to claim 10, further comprising a locking unit configured to lock the supply bobbin against rotating when the take-up bobbin is driven and the tensile force is applied to the ink ribbon.

12. The recording apparatus according to claim 10, wherein the control unit controls the separating unit to separate the recording head and the platen roller, and controls the conveying unit to convey the recording paper while the take-up bobbin driven by the take-up bobbin driving unit applies a tensile force to the ink ribbon when the conveying unit conveys the recording paper to a starting position of printing.

13. The recording apparatus according to claim 10, wherein a plurality of color regions on which each of ink colors is coated is arranged in a predetermined order on the ink ribbon, and the control unit performs control to form a color image by sequentially performing transfer onto the recording paper with respect to each color region, and wherein the control unit controls the separating unit to separate the recording head and the platen roller, and controls the conveying unit to convey the recording paper while the take-up bobbin driven by the take-up bobbin driving unit applies a tensile force to the ink ribbon when the recording paper is conveyed in an opposite direction from when transferring ink onto the recording paper to repeat transfer for each color region.

14. The recording apparatus according to claim 10, wherein the control unit controls the separating unit to separate the recording head and the platen roller, and controls the conveying unit to convey the recording paper while the take-up bobbin driven by the take-up bobbin driving unit applies a tensile force to the ink ribbon when the conveying unit ejects the recording paper from the recording apparatus.

15. A method in a recording apparatus including a supply bobbin configured to supply an ink ribbon, a take-up bobbin configured to take up the ink ribbon supplied from the supply bobbin, a take-up bobbin driving unit configured to drive the take-up bobbin, wherein the take-up bobbin driving unit includes a torque limiter configured to transmit a drive force of a drive source to the take-up bobbin, a recording head configured to transfer ink of the ink ribbon onto recording paper, and a platen roller configured to pinch and hold the ink ribbon and the recording paper in collaboration with the recording head, the method comprising:

separating the recording head from the platen roller;

locking the supply bobbin to prevent the supply bobbin from rotating;

driving the take-up bobbin to apply a tensile force to the ink ribbon while the toque limiter is skidding; and moving the recording paper between the recording head and the platen roller.

* * * * *